US007418394B2

(12) United States Patent
Cowdery

(10) Patent No.: US 7,418,394 B2
(45) Date of Patent: Aug. 26, 2008

(54) METHOD AND SYSTEM FOR OPERATING AUDIO ENCODERS UTILIZING DATA FROM OVERLAPPING AUDIO SEGMENTS

(75) Inventor: James Stuart Jeremy Cowdery, San Rafael, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 687 days.

(21) Appl. No.: 11/119,341

(22) Filed: Apr. 28, 2005

(65) Prior Publication Data

US 2006/0247928 A1 Nov. 2, 2006

(51) Int. Cl.
*G10L 19/02* (2006.01)
*G10L 19/00* (2006.01)

(52) U.S. Cl. ..... 704/500; 704/203

(58) Field of Classification Search ..... 704/200–201, 704/211–219, 222–224, 229–230, 500–501, 704/E19.001–E19.005; 381/104–109
See application file for complete search history.

(56) References Cited

U.S. PATENT DOCUMENTS 5,369,724 A * 11/1994 Lim ..... 704/200.1
5,388,181 A * 2/1995 Anderson et al. ..... 704/200.1
5,488,665 A * 1/1996 Johnston et al. ..... 381/2
5,630,012 A * 5/1997 Nishiguchi et al. ..... 704/208
5,642,383 A * 6/1997 Suzuki ..... 375/241
5,696,875 A * 12/1997 Pan et al. ..... 704/219
5,706,394 A * 1/1998 Wynn ..... 704/219
5,778,339 A * 7/1998 Sonohara et al. ..... 704/224
5,848,391 A * 12/1998 Bosi et al. ..... 704/200.1
5,917,835 A * 6/1999 Barrett et al. ..... 714/755
6,226,608 B1 * 5/2001 Fielder et al. ..... 704/229
6,370,504 B1 * 4/2002 Zick et al. ..... 704/251
6,636,829 B1 * 10/2003 Benyassine et al. ..... 704/201
6,661,430 B1 * 12/2003 Brewer et al. ..... 715/723
6,704,705 B1 * 3/2004 Kabal et al. ..... 704/230
6,772,112 B1 * 8/2004 Ejzak ..... 704/201
6,889,183 B1 * 5/2005 Gunduzhan ..... 704/207
6,990,443 B1 * 1/2006 Abe et al. ..... 704/222
7,003,449 B1 * 2/2006 Absar et al. ..... 704/200.1

(Continued)

OTHER PUBLICATIONS

Fielder, et al.; "AC-2 and AC-3: Low-Complexity Transform-Based Audio Coding," Collected Papers on Digital Audio Bit-Rate reduction, 1996, pp. 54-72, XP009045603.

*Primary Examiner*—David R. Hudspeth
*Assistant Examiner*—David Kovacek
(74) *Attorney, Agent, or Firm*—Gallagher & Lathrop P.C.; David N. Lathrop

(57) ABSTRACT

The time needed to encode an input audio stream is reduced by dividing the stream into two or more overlapping segments of audio information blocks, applying an encoding process to each segment to generate encoded segments in parallel, and appending the encoded segments to form an encoded output signal. The encoding process is responsive to one or more control parameters. Some of the control parameters, which apply to a given block, are calculated from audio information in one or more previous blocks. The length of the overlap between adjacent segments is chosen such that the differences between control parameter values and corresponding reference values at the end of the overlap interval are small enough to avoid producing audible artifacts in a signal that is obtained by decoding the encoded output signal.

24 Claims, 4 Drawing Sheets

U.S. PATENT DOCUMENTS

| | | | | |
|---|---|---|---|---|
| 7,020,615 | B2 * | 3/2006 | Vafin et al. | 704/500 |
| 7,146,312 | B1 * | 12/2006 | Demetrescu et al. | 704/229 |
| 7,197,093 | B2 * | 3/2007 | Koyata | 375/340 |
| 7,356,748 | B2 * | 4/2008 | Taleb | 714/746 |
| 7,363,230 | B2 * | 4/2008 | Matsunuma | 704/500 |
| 2002/0007273 | A1 * | 1/2002 | Chen | 704/229 |
| 2004/0024592 | A1 * | 2/2004 | Matsunuma | 704/212 |
| 2004/0039568 | A1 * | 2/2004 | Toyama et al. | 704/229 |
| 2004/0044527 | A1 * | 3/2004 | Thumpudi et al. | 704/230 |
| 2006/0200344 | A1 * | 9/2006 | Kosek et al. | 704/226 |
| 2006/0238386 | A1 * | 10/2006 | Huang et al. | 341/50 |
| 2007/0140499 | A1 * | 6/2007 | Davis | 381/23 |
| 2007/0185707 | A1 * | 8/2007 | Gerrits et al. | 704/201 |

* cited by examiner

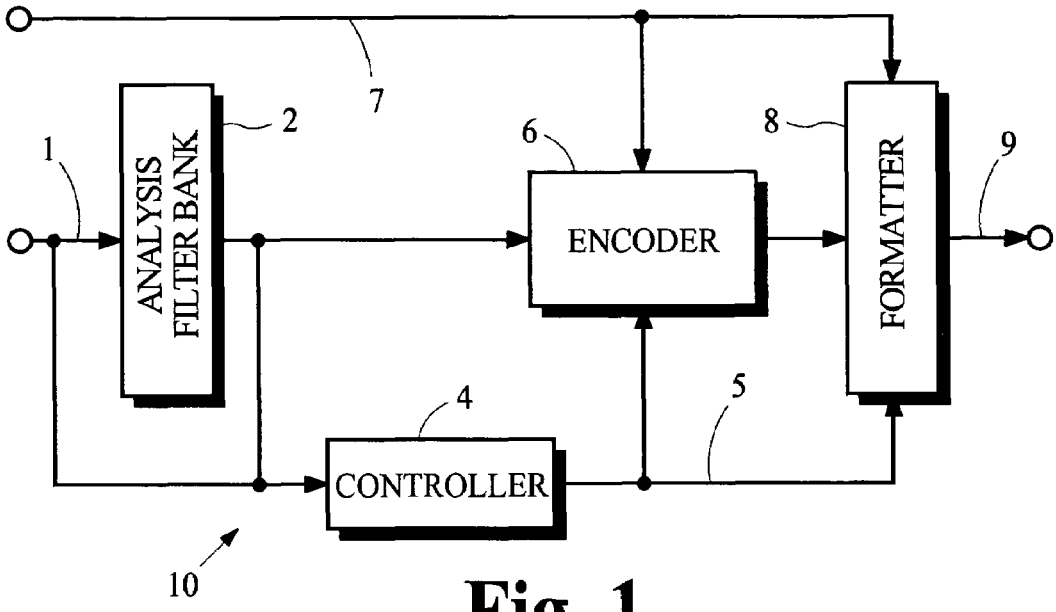
Fig. 1
Fig. 2A
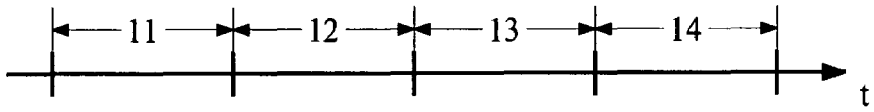
Fig. 2B
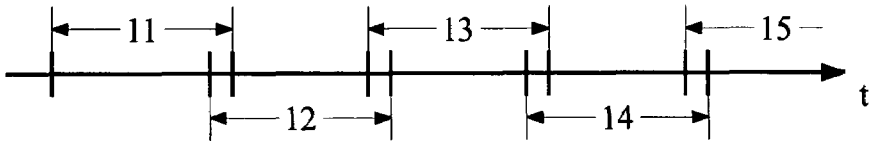
Fig. 2C
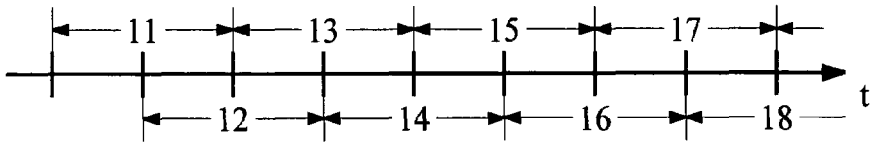
Fig. 3
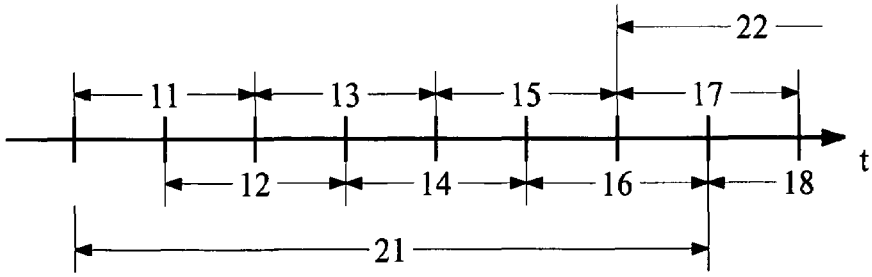

METHOD AND SYSTEM FOR OPERATING AUDIO ENCODERS UTILIZING DATA FROM OVERLAPPING AUDIO SEGMENTS

TECHNICAL FIELD

The present invention pertains generally to audio coding and pertains specifically to methods and systems for applying in parallel two or more audio encoding processes to segments of an audio information stream to encode the audio information.

BACKGROUND ART

Audio coding systems are often used to reduce the amount of information required to adequately represent a source signal. By reducing information capacity requirements, a signal representation can be transmitted over channels having lower bandwidth or stored on media using less space. Perceptual audio coding can reduce the information capacity requirements of a source audio signal by eliminating either redundant components or irrelevant components in the signal. This type of coding often uses filter banks to reduce redundancy by decorrelating a source signal using a basis set of spectral components, and reduces irrelevancy by adaptive quantization of the spectral components according to psycho-perceptual criteria.

The filter banks may be implemented in many ways including a variety of transforms such as the Discrete Fourier Transform (DFT) or the Discrete Cosine Transform (DCT), for example. A set of transform coefficients or spectral components representing the spectral content of a source audio signal can be obtained by applying a transform to blocks of time-domain samples representing time intervals of the source audio signal. A particular Modified Discrete Cosine Transform (MDCT) described in Princen et al., "Subband/Transform Coding Using Filter Bank Designs Based on Time Domain Aliasing Cancellation," Proc. of the 1987 International Conference on Acoustics, Speech and Signal Processing (ICASSP), May 1987, pp. 2161-64, is widely used because it has several very attractive properties for audio coding including the ability to provide critical sampling while allowing adjacent source signal blocks to overlap one another. Proper operation of the MDCT filter bank requires the use of overlapped source-signal blocks and window functions that satisfy certain criteria. Two examples of coding systems that use the MDCT filter bank are those systems that conform to the Advanced Audio Coder (AAC) standard, which is described in Bosi et al., "ISO/IEC MPEG-2 Advanced Audio Coding," J. Audio Eng. Soc., vol. 45, no. 10, October 1997, pp. 789-814, and those systems that conform to the Dolby Digital encoded bit stream standard. This coding standard, sometimes referred to as AC-3, is described in the Advanced Television Systems Committee (ATSC) A/52A document entitled "Revision A to Digital Audio Compression (AC-3) Standard" published Aug. 20, 2001. Both references are incorporated herein by reference.

A coding process that adapts the quantizing resolution can reduce signal irrelevancy but it may also introduce audible levels of quantization error or "quantization noise" into the signal. Perceptual coding systems attempt to control the quantizing resolution so that the quantization noise is "masked" or rendered imperceptible by the spectral content of the signal. These systems typically use perceptual models to predict the levels of quantization noise that can be masked by a source signal and they typically control the quantizing resolution by allocating a varying number of bits to represent each quantized spectral component so that the total bit allocation satisfies some allocation constraint.

Perceptual coding systems may be implemented in a variety of ways including special purpose hardware, digital signal processing (DSP) computers, and general purpose computers. The filter banks and the bit allocation processes used in many coding systems require significant computational resources. As a result, encoders implemented by conventional DSP and general purpose computers that are commonly available today usually cannot encode a source audio signal much faster than in "real time," which means the time needed to encode a source audio signal is often about the same as or even greater than the time needed to present or "play" the source audio signal. Although the processing speed of DSP and general purpose computers is increasing, the demands imposed by growing complexity in the encoding processes counteracts the gains made in hardware processor speed. As a result, it is unlikely that encoders implemented by either DSP or general purpose computers will be able to encode source audio signals much faster than in real time.

One application for AC-3 coding systems is the encoding of soundtracks for motion pictures on DVDs. The length of a soundtrack for a typical motion picture is on the order of two hours. If the coding process is implemented by DSP or general purpose computers, the coding will also take approximately two hours. One way to reduce the encoding time is to execute different parts of the encoding process on different processors or computers. This approach is not attractive, however, because it requires redesigning the encoding process for operation on multiple processors, it is difficult if not impossible to design the encoding process for efficient operation on varying numbers of processors, and such a redesigned encoding process requires multiple computers even for short lengths of source signals.

What is needed is a way to use an arbitrary number of conventional audio encoding processes that can reduce encoding time.

DISCLOSURE OF INVENTION

The present invention provides a way to use multiple instances of a conventional audio encoding process that reduces the time needed to encode a source audio signal.

According to one aspect of the invention, a stream of audio information comprising audio samples arranged in a sequence of blocks is encoded by identifying first and second segments of the stream of audio information that overlap one another by an overlap interval equal to an integer number of blocks, applying a first encoding process to the first segment of the stream of audio information to generate blocks of first encoded audio information and a first control parameter, applying a second encoding process to the second segment of the stream of audio information to generate blocks of second encoded audio information and a second control parameter, and assembling the blocks of first and second encoded audio information into an output signal. The first encoding process generates blocks of first encoded audio information and the first control parameter in response to all blocks of audio samples in the first segment of audio information. The second encoding process generates the second control parameter in response to all blocks of audio samples in the second segment of audio information but may generate blocks of second encoded audio information for only those blocks of audio samples that follow the overlap interval. The length of the overlap interval is chosen such that a difference between first and second parameter values for the last block in the overlap interval is less than some desired threshold. The control parameters may be assembled into the output signal or used to adapt the operation of the first and second encoding processes. Preferably, the first and second encoding processes are identical.

The various features of the present invention and its preferred embodiments may be better understood by referring to the following discussion and the accompanying drawings in which like reference numerals refer to like elements in the several figures. The contents of the following discussion and the drawings are set forth as examples only and should not be understood to represent limitations upon the scope of the present invention.

BRIEF DESCRIPTION OF DRAWINGS

FIG. 1 is a schematic block diagram of an encoding transmitter for use in a coding system that may incorporate various aspects of the present invention.

FIGS. 2A to 2C are schematic diagrams of audio information arranged in a sequence of blocks.

FIG. 3 is schematic diagram of audio information blocks arranged in adjacent frames of audio information.

MODES FOR CARRYING OUT THE INVENTION

A. Introduction

Figure 4:
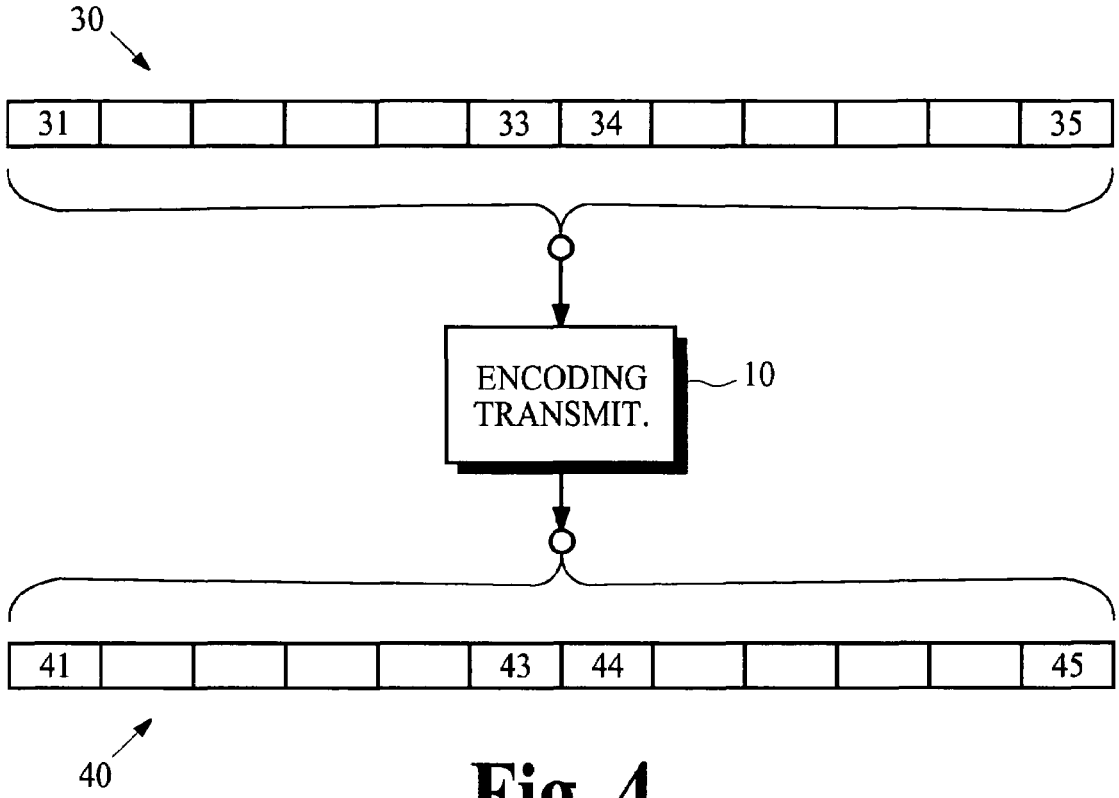
FIG. 4 is a schematic block diagram of an encoding transmitter that processes input audio information to generate an encoded output signal.

FIG. 1 illustrates one implementation of an audio encoding transmitter 10 that can be used with various aspects of the present invention. In this implementation, the transmitter 10 applies the analysis filter bank 2 to a source signal received from the path 1 to generate spectral components that represent the spectral content of the source signal, analyzes the source signal or the spectral components in the controller 4 to generate one or more control parameters along the path 5, encodes the spectral components in the encoder 6 to generate encoded information by using an encoding process that may be adapted in response to the control parameters, and applies the formatter 8 to the encoded information to generate an output signal along the path 9. The output signal may be provided to other devices for additional processing or it may be immediately recorded oh storage media. The path 7 is optional and is discussed below.

The analysis filter bank 2 may be implemented in variety of ways including a wide range of digital filter technologies, wavelet transforms and block transforms. Analysis filter banks that are implemented by some type of digital filter such as a polyphase filter, rather than a block transform, split an input signal into a set of subband signals. Each subband signal is a time-based representation of the spectral content of the input signal within a particular frequency subband. Preferably, the subband signal is decimated so that each subband signal has a bandwidth that is commensurate with the number of samples in the subband signal for a unit interval of time. Although many types of implementations of the analysis filter bank 2 can be applied to a continuous input stream of audio information, it is common to apply these implementations to blocks of audio information to facilitate various types of encoding processes such as block scaling, adaptive quantization based on psychoacoustic models, or entropy coding.

Analysis filter banks that are implemented by block transforms convert a block or interval of an input signal into a set of transform coefficients that represent the spectral content of that interval of signal. A group of one or more adjacent transform coefficients represents the spectral content within a particular frequency subband having a bandwidth commensurate with the number of coefficients in the group.

FIGS. 2A to 2C are schematic illustrations of streams of digital audio information arranged in a sequence of blocks that may be processed by an analysis filter bank to generate spectral components. Each block contains digital samples that represent a time interval of an audio signal. In FIG. 2A, adjacent blocks or time intervals 11 to 14 in a sequence of blocks abut one another. The block 12, for example, immediately follows and abuts the block 11. In FIG. 2B, adjacent blocks or time intervals 11 to 15 in a sequence of blocks overlap one another by amount that is one-eighth of the block length. The block 12, for example, immediately follows and overlaps the block 11. In FIG. 2C, adjacent blocks or time intervals 11 to 18 in a sequence of blocks overlap one another by amount that is one-half of the block length. The block 12, for example, immediately follows and overlaps the block 11. The amounts of overlap that are illustrated in these figures are shown only as examples. No particular amount of overlap is important in principle to the present invention.

The following discussion refers more particularly to implementations of the encoding transmitter 10 that use the MDCT as an analysis filter bank. This transform is applied to a sequence of blocks that overlap one another by one-half the block length as shown in FIG. 2C. In this discussion, the term "spectral components" refers to the transform coefficients and the terms "frequency subband" and "subband signal" pertain to groups of one or more adjacent transform coefficients. Principles of the present invention may be applied to other types of implementations, however, so the terms "frequency subband" and "subband signal" pertain also to a signal representing spectral content of a portion of the whole bandwidth of a signal, and the term "spectral components" generally may be understood to refer to samples or elements of the subband signal. Perceptual coding systems usually implement the analysis filter bank to provide frequency subbands having bandwidths that are commensurate with the so called critical bandwidths of the human auditory system.

The controller 4 may implement a wide variety of processes to generate the one or more control parameters. In the implementation shown in FIG. 1, these control parameters are passed along the path 5 to the encoder 6 and the formatter 8. In other implementations, the control parameters may be passed to only the encoder 6 or to only the formatter 8. In one implementation, the controller 4 applies a perceptual model to the spectral components to obtain a "masking curve" that represents an estimate of the masking effects of the source signal and derives from the spectral components one or more control parameters that the encoder 6 uses with the masking curve to allocate bits for quantizing the spectral components. For this implementation, it is not necessary to pass these control parameters to the formatter 8 if a complimentary decoding process can derive them from other information that is conveyed by the output signal. In another implementation, the controller 4 derives one or more control parameters from at least some of the spectral components and passes them to the formatter 8 for inclusion with the encoded information in the output signal passed along the path 9. These control parameters may be used by a complimentary decoding process to recover and playback an audio signal from the encoded information.

The encoder 6 may implement essentially any encoding process that may be desired for a particular application. In this disclosure, terms like "encoder" and "encoding" are not intended to imply any particular type of information processing. For example, encoding is often used to reduce information capacity requirements; however, these terms in this disclosure do not necessarily refer to this type of processing. The encoder 6 may perform essentially any type of processing that is desired. In one implementation mentioned above, encoded information is generated by quantizing spectral components according to a masking curve obtained from a perceptual model. Other types of processing may be performed in the encoder 6 such as entropy coding or discarding spectral components for a portion of a signal bandwidth and providing an estimate of the spectral envelope of the discarded portion with the encoded information. No particular type of encoding is important to the present invention.

The formatter 8 may use multiplexing or other known processes to assemble the encoded information into the output signal having a form that is suitable for a particular application. Control parameters may also be assembled into the output signal as desired.

B. Exemplary Implementation

One implementation of the encoding transmitter 10, which generates a bit stream conforming to the standard described in the ATSC A/52A document cited above, implements its filter bank 2 by the MDCT. This particular transform is applied to streams of audio information for one or more channels. A stream for a particular channel is composed of audio samples that are arranged in a sequence of blocks in which adjacent blocks overlap one another by one-half the block length as illustrated in FIG. 2C. The blocks for all channels are aligned in time with one another. A set of six adjacent blocks for each channel, which are also aligned with one another, constitute a "frame" of audio information.

The encoder 6 generates encoded information by applying an encoding process to blocks of spectral components representing a frame of audio information. The controller 4 generates one or more control parameters that are used to adapt the encoding process for each block or frame. The controller 4 may also generate one or more control parameters for each block or frame to be assembled into the output signal generated along the path 9 for use by a decoding receiver. A control parameter for a block or frame is generated in response to audio information in only that respective block or frame. An example of this type of control parameter, referred to herein as a Type I parameter, is an array of values that defines a calculated masking curve for a particular block. (See the array "mask" in the ATSC A/52A specification.) Other control parameters for a respective block or frame are generated in response to audio information that precedes the respective block or frame. An example of this type of control parameter, referred to herein as a Type II parameter, is a compression value for the playback level of a decoded signal. (See the parameter "compr" in the ATSC A/52A specification.) A Type II parameter for a given block or frame may be generated in response to audio information within that block or frame as well as audio information that precedes the given block or frame. When the encoding transmitter 10 processes a stream of audio information, the values for the Type I parameters for a respective block or frame are recalculated independently for that block or frame but the values for the Type II parameters are calculated in a way that depends on the audio information in prior blocks or frames. For ease of explanation, the following discussion refers only to control parameters that apply to individual frames or to all blocks within individual frames. These examples and the underlying principles also apply to control parameters that apply to individual blocks.

FIG. 3 schematically illustrates blocks of audio information grouped into the frames 21 and 22. Type I control parameter values that are calculated by the controller 4 for the frame 22 depend on the audio information within only the frame 22 but Type II parameter values for the frame 22 depend on audio information within the frame 21 and possibly other frames that precede the frame 21. Type II parameter values for the frame 22 may also depend on audio information in that frame. For ease of discussion, the following examples assume Type II parameter values for a particular frame are derived from audio information in that frame as well as one or more preceding frames.

C. Parallel Processing

For many implementations of the encoding transmitter 10, a multichannel input audio stream can be encoded in approximately the same amount of time as that needed to play the input audio stream. The input audio stream 30 shown in FIG. 4 that begins with the input frame 31 and ends with the input frame 35, which plays in two hours for example, can be encoded by the encoding transmitter 10 in about two hours to produce an output signal 40 with blocks of encoded information arranged in frames that begins with the output frame 41 and ends with the output frame 45.

The time for encoding can be reduced by approximately a factor of N by dividing an audio stream into N segments of approximately equal length, encoding each segment by a respective encoding transmitter to produce N encoded signal segments in parallel, and appending the encoded signal segments to one another to obtain an output signal. An example shown in FIG. 5 divides the audio stream 30 into two segments 30-1 and 30-2, encodes the two segments by the encoding transmitters 10-1 and 10-2, respectively, to generate two encoded signal segments 40-1 and 40-2 in parallel, and appends the encoded signal segment 40-2 to the end of the encoded signal segment 40-1 to obtain the output signal 40'. Unfortunately, an audio signal that is decoded from the output signal 40' generally will differ audibly from an audio signal that is decoded from the output signal 40 generated by a single encoding transmitter 10. This audible difference is caused by differences in Type II parameter values that the encoding transmitter 10 uses at the beginning of each segment. The cause and solution of this problem is discussed below. The following examples assume all instances of the encoding transmitter are implemented in such a way that they generate identical output signals from the same input audio stream.

Figure 5:
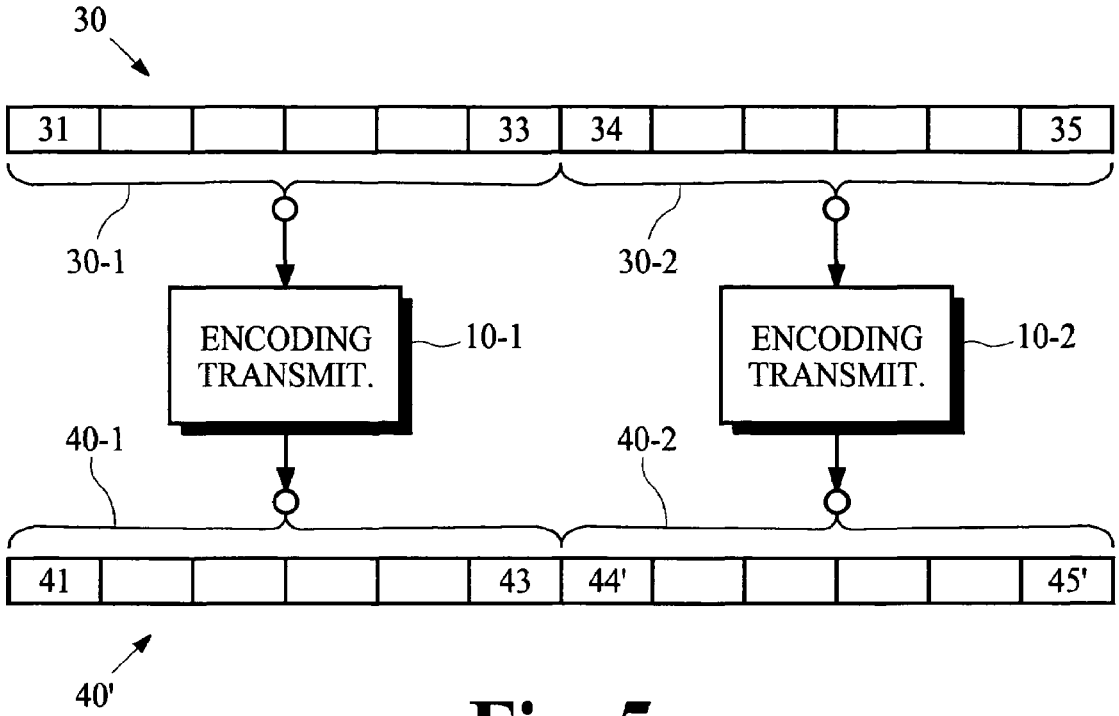
FIG. 5 is a schematic block diagram of multiple encoding transmitters arranged to encode audio signal segments in parallel.

Referring to the examples shown in FIGS. 4 and 5, blocks of encoded information in each output frame are generated in response to audio information blocks in a corresponding input frame, in response to one or more Type I parameters calculated from audio information in the corresponding input frame, and in response to one or more Type II parameters calculated from audio information in the corresponding input frame and one or more preceding frames. The blocks of encoded information in the output frame 43, for example, are generated in response to blocks of audio information in the input frame 33, in response to Type I parameters calculated from the audio information in the input frame 33, and in response to Type II parameters calculated from audio information in the input frame 33 and in one or more preceding input frames. Blocks in the output frame 41 are generated in response to blocks of audio information in the input frame 31, in response to Type I parameters calculated from the audio information in the input frame 31, and in response to Type II parameters calculated from audio information in the input frame 31. The Type II parameters for the input frame 31 do not depend on the audio information in any preceding frame because the input frame 31 is the first frame in the input audio stream 30 and there are no preceding input frames. The Type II parameters for the blocks in the input frame 31 are initialized from the audio information conveyed only in the input frame 31. The encoded information in the output frames of the output signal 40 beginning with the output frame 41 to the output frame 43 is identical to the encoded information in corresponding output frames of the encoded signal segment 40-1 because the encoding transmitter 10 and the encoding transmitter 10-1 receives and processes identical blocks of audio information in the input audio stream from the start of the input frame 31 to the end of the input frame 33.

The encoded information in the output frames of the latter half of the output signal 40 starting with the output frame 44 is generally not identical to the encoded information in the output frames of the latter half of the output signal 40' starting with the output frame 44'. Referring to FIG. 4, the blocks of encoded information in the output frame 44 are generated in response to blocks of audio information in the input frame 34, in response to Type I parameters calculated from the audio information in the input frame 34, and in response to Type II parameters calculated from audio information in the input frame 34 and in one or more preceding input frames. Referring to FIG. 5, blocks in the output frame 44' are generated in response to blocks of audio information in the input frame 34, in response to Type I parameters calculated from the audio information in the input frame 34, and in response to Type II parameters calculated from audio information in the input frame 34. The Type II parameters for the input frame 34 do not depend on the audio information in any preceding frame because the input frame 34 is the first frame in the segment 30-2 and there are no preceding input frames. The Type II parameters for the blocks in the input frame 34 are initialized from the audio information conveyed in the input frame 34. In general, the Type II parameters used by the encoding transmitters 10 and 10-2 to encode blocks of audio information in the input frame 34 are not identical; therefore, the frames of encoded information that they generate are not identical.

Figure 6:
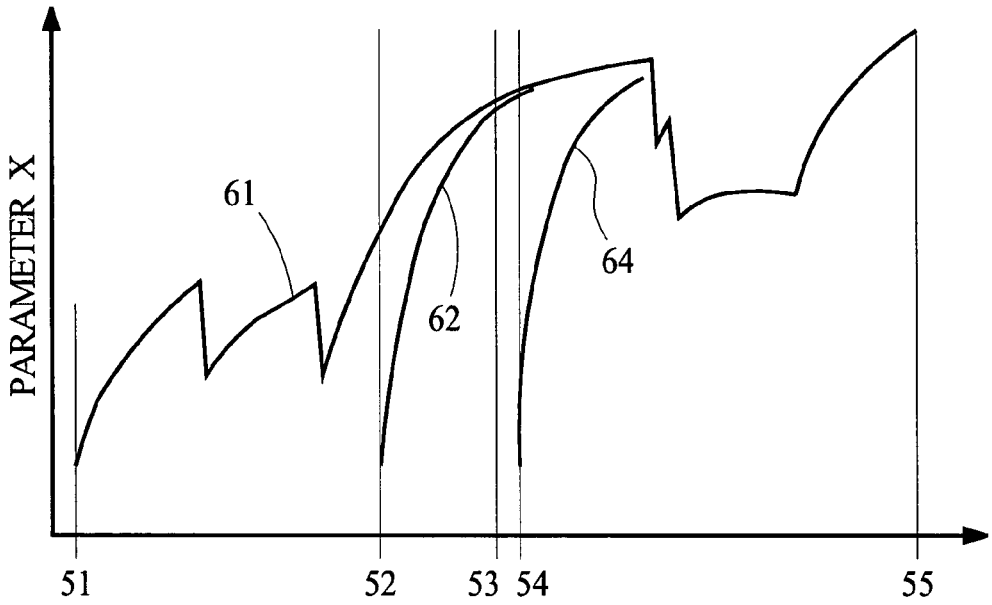
FIG. 6 is a graphical illustration of values for a hypothetical Type II parameter.

FIG. 6 illustrates how the value for a hypothetical Type II parameter "X" varies in one implementation of the encoding transmitter 10. The reference lines 51, 53, 54 and 55 represent points in time corresponding to the start of the input frames 31, 33, 34 and 35, respectively. Curve 61 represents the value of the "X" parameter that the encoding transmitter 10 in FIG. 4 calculates by processing blocks of audio information in the input audio stream 30 beginning with the input frame 31 and ending with the input frame 35. This curve specifies values that are referred to below as the reference values for the "X" parameter. Curve 64 represents the value of the "X" parameter that the encoding transmitter 10-2 in FIG. 5 calculates by processing blocks of audio information in the input audio stream 30-2 beginning with the input frame 34. The vertical distance between the points where curves 61 and 64 intersect the line 54 represents the difference between the values of the Type II parameter "X" that are used by the two encoding transmitters to encode the blocks of audio information in the input frame 34.

When the encoded information in the output frames 43 and 44 in the output signal 40 is decoded and played, audio information that is affected by the value of the "X" parameter will change very little because, as shown by the small increase of curve 61 from line 53 to 54, the value of the "X" parameter changes very little. In contrast, when the encoded information in the output frames 43 and 44' in the output signal 40' is decoded and played, audio information that is affected by the value of the "X" parameter changes to a much greater extent because, as shown by the large decrease between the curve 61 at line 53 and the curve 64 at line 54, the value of the "X" parameter changes greatly. If the hypothetical "X" parameter is the "compr" parameter mentioned above, for example, it is likely such a large change would produce a large and abrupt change in playback level. Other Type II parameters could produce other types of artifacts such as clicks, pops or thumps.

Figure 7:
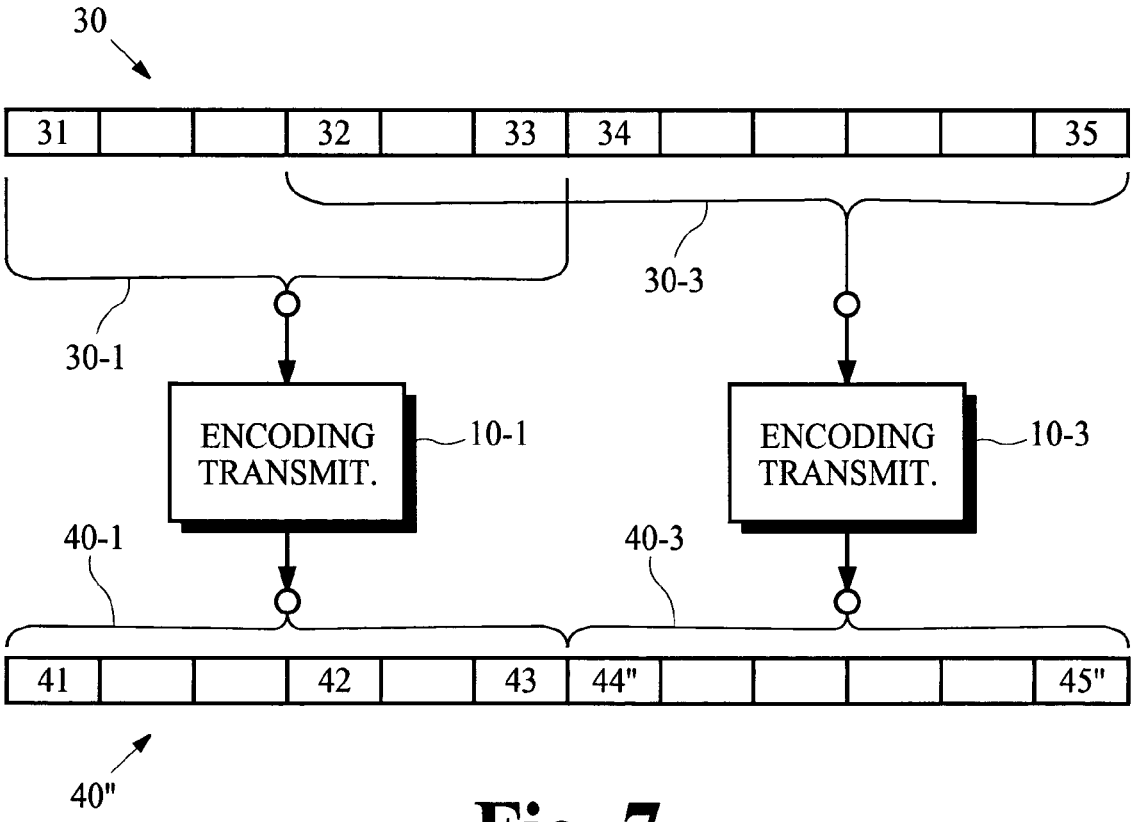
FIG. 7 is a schematic block diagram of multiple encoding transmitters arranged to encode overlapping audio signal segments in parallel.

This problem can be overcome as shown in FIG. 7 by having the encoding transmitter 10-1 process the audio information in the segment 30-1 as described above to generate the encoded segment 40-1 with the output frames 41, 42 and 43, and by having the encoding transmitter 10-3 process the audio information in the segment 30-3, which includes audio information blocks in one or more frames that precede the input frame 34, so that the Type II parameter values for the input frame 34 differ insignificantly from the corresponding reference values for that frame. Referring to FIG. 6, curve 62 represents the "X" parameter values that the encoding transmitter 10-3 calculates by processing blocks of audio information in the segment 30-3 beginning with the input frame 32. The reference value for the "X" parameter on the curve 61 at the line 54 is much closer to the "X" parameter value on the curve 62 at the line 54 than it is to the corresponding parameter value on the curve 64 at the line 54. If the difference between the curve 61 and the curve 62 at the line 54 is small enough, then no audible artifact will be generated in the audio signal that is decoded and played from the output signal 40" obtained by appending the encoded signal segment 40-3 to the encoded signal segment 40-1.

Figure 8:
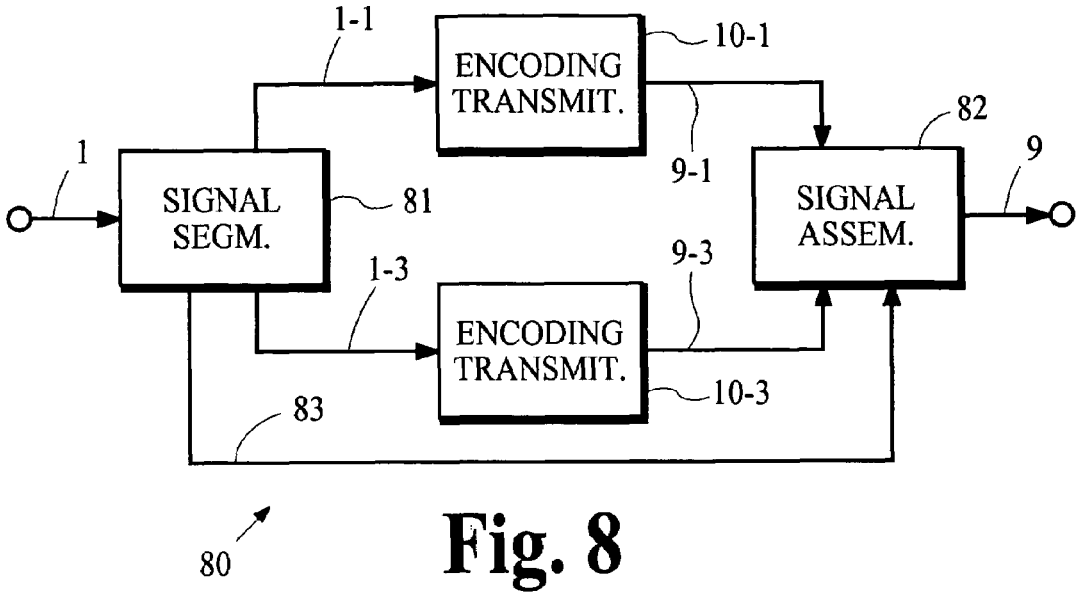
FIGS. 8-9 are schematic block diagrams of systems for controlling multiple encoding transmitters that operate in parallel.

Any encoded information that the encoding transmitter 10-3 may generate in response to audio information blocks preceding the input frame 34 is not included in the encoded signal segment 40-3. This may be accomplished in a variety of ways. One way that is implemented by the system 80 shown in FIG. 8 uses a signal segmenter 81 to divide the input audio stream 30 into overlapping segments as illustrated in FIG. 7. The segment 30-1 including audio information beginning with the input frame 31 and ending with the input frame 33 is passed along the path 1-1 to the encoding transmitter 10-1. The segment 30-3 including audio information beginning with the input frame 32 and ending with the input frame 35 is passed along the path 1-3 to the encoding transmitter 10-3. The signal segmenter 81 generates along the path 83 a control signal that indicates the location of the input frame 34. The signal assembler 82 receives from the path 9-1 a first output signal segment generated by the encoding transmitter 10-1, receives from the path 9-3 a second output signal segment generated by the encoding transmitter 10-3, discards all output frames in the second output signal segment that precede the output frame 44" in response to the control signal received from the path 83, and appends the remaining output frames in the second output signal segment beginning with the output frame 44" and ending with the output frame 34" to the first output signal segment received from the encoding transmitter 10-1.

Figure 9:
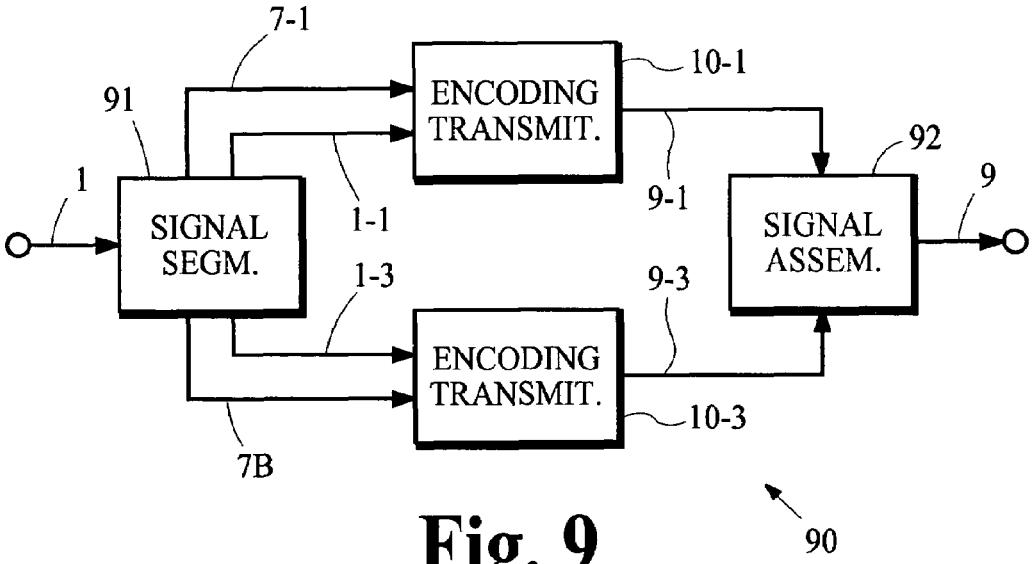

Another way that is implemented by the system 90 shown in FIG. 9 uses a modified implementation of the encoding transmitter 10 that is illustrated schematically in FIG. 1. According to this modified implementation, the encoding transmitter 10 receives a control signal from the path 7 and, in response, causes the formatter 8 to suppress the generation of output frames. In addition, the encoder 6 may also respond by suppressing the processing that is not needed to calculate the Type II parameters. System 90 uses a signal segmenter 91 to divide an input audio stream 30 into overlapping segments as illustrated in FIG. 7. Audio information in the first segment 30-1 is passed along the path 1-1 to the encoding transmitter 10-1. Audio information in the second segment 30-3 is passed along the path 1-3 to the encoding transmitter 10-3. The signal segmenter 91 generates along the path 7-1 a first control signal that indicates all audio information in the first segment 30-1 is to be encoded by the encoding transmitter 10-1. The signal segmenter 91 generates along the path 7-3 a second control signal that indicates only the audio information in the second segment 30-3 that begins with the input frame 34 is to be encoded by the encoding transmitter 10-3. The encoding transmitter 10-3 processes audio information in all input frames of the second segment 30-3 to calculate its Type II parameter values but it encodes the audio information in only that part of the segment which begins with the input frame 34. The signal assembler 92 receives from the path 9-1 the output signal segment 40-1 generated by the encoding transmitter 10-1, receives from the path 9-3 the output signal segment 40-3 generated by the encoding transmitter 10-3, and appends the two signal segments to generate the desired output signal.

D. Segmentation

A variety of processes may be used to control the segmentation of an input audio stream 30. A few exemplary processes may be explained more easily by defining the term "initialization interval" as the overlap between two adjacent segments. The initialization interval for given segment starts at the beginning of that segment and ends at the beginning of the block that immediately follows the last block in the previous segment. The example in FIG. 7 shows an input audio stream 30 divided into two segments 30-1 and 30-2. The first segment begins with the input frame 31 and ends with the input frame 33, and the second segment begins with the input frame 32 and ends with the input frame 35. The initialization interval for the second segment 30-2 is the interval that starts at the beginning of the first block in the input frame 32 and ends at the beginning of the first block in the input frame 34. When adjacent frames overlap as shown in FIG. 3, for example, the initialization interval for a subsequent segment ends at a point within the last frame of the previous segment.

A longer initialization interval will generally reduce the difference between a Type II parameter value and its corresponding reference value at the end of the initialization interval but it will also increase the amount of time needed to encode an input audio stream segment. Preferably, the length of initialization intervals are chosen to be as short as possible such that the differences between all pertinent Type II parameter values and their corresponding reference values at the end of the initialization interval are less than some threshold. For example, a threshold may established to prevent the generation of an audible artifact in the audio information that is decoded from the output signal. The maximum allowable differences in the Type II parameter values may be determined empirically or, alternatively, differences in parameter values may be limited such that resulting changes in playback loudness are no more than about 1 dB. If a pertinent Type II parameter value is quantized, the initialization interval may be chosen to be as short as possible such that the difference between the quantized Type II parameter value and the corresponding quantized reference value is no more than a specified number of quantization steps.

The following example assumes the encoding transmitter 10 implements processing and generates an output signal that conform to the standard described in the ATSC A/52A document cited above. In this implementation, an input audio stream is arranged in blocks of 512 samples. Adjacent blocks in the stream overlap one another by one-half block length and are arranged in frames that include six blocks per audio channel. The initialization interval is equal to an integer number of complete input frames. A suitable minimum initialization interval for many applications including the encoding of motion picture soundtracks is about thirty-five seconds, which is about 1,094 input frames if the audio sample rate is 48 kHz and about 1,005 input frames if the audio sample rate is 44.1 kHz.

E. Implementation

Figure 10:
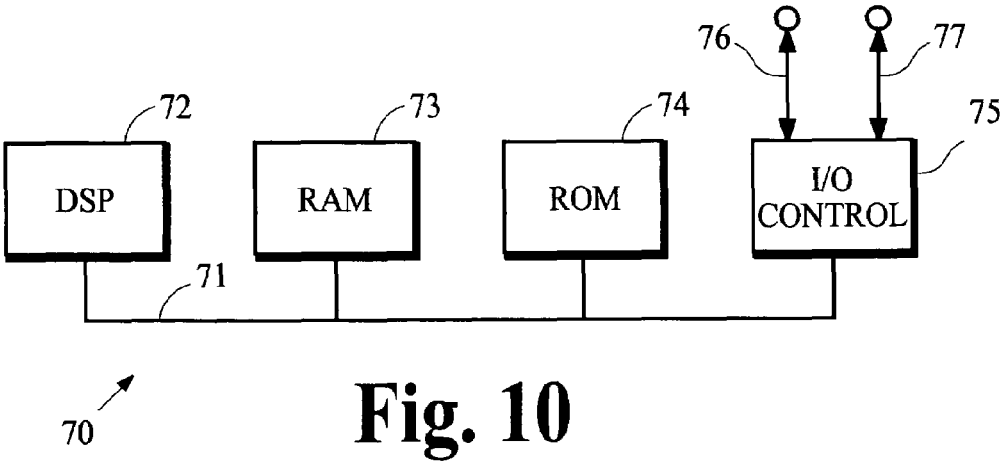
FIG. 10 is a schematic block diagram of a device that may be used to implement various aspects of the present invention.

Devices that incorporate various aspects of the present invention may be implemented in a variety of ways including software for execution by a computer or some other device that includes more specialized components such as digital signal processor (DSP) circuitry coupled to components similar to those found in a general-purpose computer. FIG. 10 is a schematic block diagram of a device 70 that may be used to implement aspects of the present invention. The processor 72 provides computing resources. RAM 73 is system random access memory (RAM) used by the processor 72 for processing. ROM 74 represents some form of persistent storage such as read only memory (ROM) for storing programs needed to operate the device 70 and possibly for carrying out various aspects of the present invention. I/O control 75 represents interface circuitry to receive and transmit signals by way of the communication channels 76, 77. In the embodiment shown, all major system components connect to the bus 71, which may represent more than one physical or logical bus; however, a bus architecture is not required to implement the present invention.

In embodiments implemented by a general purpose computer system, additional components may be included for interfacing to devices such as a keyboard or mouse and a display, and for controlling a storage device 78 having a storage medium such as magnetic tape or disk, or an optical medium. The storage medium may be used to record programs of instructions for operating systems, utilities and applications, and may include programs that implement various aspects of the present invention.

The functions required to practice various aspects of the present invention can be performed by components that are implemented in a wide variety of ways including discrete logic components, integrated circuits, one or more ASICs and/or program-controlled processors. The manner in which these components are implemented is not important to the present invention.

Software implementations of the present invention may be conveyed by a variety of machine readable media such as baseband or modulated communication paths throughout the spectrum including from supersonic to ultraviolet frequencies, or storage media that convey information using essentially any recording technology including magnetic tape, cards or disk, optical cards or disc, and detectable markings on media including paper.

The invention claimed is:

1. A method for encoding a stream of audio information comprising audio samples arranged in a sequence of blocks, each block having a respective start and end, wherein a first block precedes a second block, a third block follows the second block, a fourth block immediately follows the third block, and a fifth block follows the fourth block, and wherein the method comprises:

(a) identifying first and second segments of the stream of audio information that overlap one another by an overlap interval, wherein (1) the first segment comprises a plurality of blocks that starts with the first block and ends with the third block, (2) the second segment comprises a plurality of blocks that starts with the second block, includes the fourth block, and ends with the fifth block, and (3) the overlap interval extends from the start of the second block to the start of the fourth block;

(b) applying a first encoding process to the first segment of the stream of audio information to generate blocks of first encoded audio information and a first control parameter corresponding to blocks of audio samples up to and including the third block, wherein (1) the first encoded audio information in a block is generated in response to a corresponding block of audio samples in the first segment of the stream of audio information up to and including the third block;

(2) the first control parameter in the block is generated in response to the corresponding block of audio samples and preceding blocks of audio samples in the first segment of the stream of audio information from the first block up to and including the third block, and (c) applying a second encoding process to the second segment of the stream of audio information to generate blocks of second encoded audio information and a second control parameter corresponding to blocks of audio samples from the fourth block up to and including the fifth block, and to generate a second control parameter corresponding to audio samples in the third block, wherein (1) the second encoded audio information in a block is generated in response to a corresponding block of audio samples in the second segment of the stream of audio information from the fourth block up to and including the fifth block, (2) the second control parameter in the block is generated in response to the corresponding block of audio samples and preceding blocks of audio samples in the second segment of the stream of audio information from the second block up to and including the fifth block, and (3) the overlap interval is such that a difference between values of the first and second control parameters for the third block is less than a threshold amount; and (d) assembling the blocks of first and second encoded audio information into an output signal, wherein (1) the first and second control parameters are assembled into the output signal, or (2) the first encoding process generates the first encoded audio information in response to the first control parameter and the second encoding process generates the second encoded audio information in response to the second control parameter.

2. The method according to claim 1, wherein the stream of audio information is arranged in frames, each frame having a plurality of blocks, the first, second and fourth blocks are beginning blocks in respective frames, and the third and fifth blocks are ending blocks in respective frames.

3. The method according to claim 1, wherein the first and second encoding processes generate encoded audio information by applying filterbanks to the blocks of audio samples that cause time-domain aliasing artifacts to be generated by complementary decoding processes applied to the encoded audio information, and the blocks of audio samples in the sequence of blocks overlap one another by an amount that allows the complementary decoding processes to mitigate effects of the time-domain aliasing artifacts.

4. The method of claim 1, wherein the first and second control parameters are assembled into the output signal and the overlap interval is greater than thirty-five seconds.

5. The method of claim 1, wherein the first and second encoding processes are responsive to the first and second control parameters, respectively, and the overlap interval is greater than 4,500 milliseconds.

6. The method of claim 1, wherein the threshold amount is such that differences in audio signals decoded from encoded audio information for the third block according to the first and second control parameters are imperceptible.

7. The method of claim 1, wherein the first and second control parameters represent values of a factor used in a decoding process that is complementary to the first and second encoding processes, and wherein the threshold amount represents a change in the factor equal to 1 dB.

8. The method of claim 1, wherein the first and second control parameters are represented by values that are quantized according to a quantization step size and the threshold amount is an integer number of quantization step sizes greater than or equal to zero.

9. An apparatus for encoding a stream of audio information comprising audio samples arranged in a sequence of blocks, each block having a respective start and end, wherein a first block precedes a second block, a third block follows the second block, a fourth block immediately follows the third block, and a fifth block follows the fourth block, wherein the apparatus comprises:

(a) means for identifying first and second segments of the stream of audio information that overlap one another by an overlap interval, wherein (1) the first segment comprises a plurality of blocks that starts with the first block and ends with the third block, (2) the second segment comprises a plurality of blocks that starts with the second block, includes the fourth block, and ends with the fifth block, and (3) the overlap interval extends from the start of the second block to the start of the fourth block;

(b) means for applying a first encoding process to the first segment of the stream of audio information to generate blocks of first encoded audio information and a first control parameter corresponding to blocks of audio samples up to and including the third block, wherein (1) the first encoded audio information in a block is generated in response to a corresponding block of audio samples in the first segment of the stream of audio information up to and including the third block;

(2) the first control parameter in the block is generated in response to the corresponding block of audio samples and preceding blocks of audio samples in the first segment of the stream of audio information from the first block up to and including the third block, and (c) means for applying a second encoding process to the second segment of the stream of audio information to generate blocks of second encoded audio information and a second control parameter corresponding to blocks of audio samples from the fourth block up to and including the fifth block, and to generate a second control parameter corresponding to audio samples in the third block, wherein (1) the second encoded audio information in a block is generated in response to a corresponding block of audio samples in the second segment of the stream of audio information from the fourth block up to and including the fifth block, (2) the second control parameter in the block is generated in response to the corresponding block of audio samples and preceding blocks of audio samples in the second segment of the stream of audio information from the second block up to and including the fifth block, and (3) the overlap interval is such that a difference between values of the first and second control parameters for the third block is less than a threshold amount; and (d) means for assembling the blocks of first and second encoded audio information into an output signal, wherein (1) the first and second control parameters are assembled into the output signal, or (2) the first encoding process generates the first encoded audio information in response to the first control parameter and the second encoding process generates the second encoded audio information in response to the second control parameter.

10. The apparatus according to claim 9, wherein the stream of audio information is arranged in frames, each frame having a plurality of blocks, the first, second and fourth blocks are beginning blocks in respective frames, and the third and fifth blocks are ending blocks in respective frames.

11. The apparatus according to claim 9, wherein the first and second encoding processes generate encoded audio information by applying filterbanks to the blocks of audio samples that cause time-domain aliasing artifacts to be generated by complementary decoding processes applied to the encoded audio information, and the blocks of audio samples in the sequence of blocks overlap one another by an amount that allows the complementary decoding processes to mitigate effects of the time-domain aliasing artifacts.

12. The apparatus of claim 9, wherein the first and second control parameters are assembled into the output signal and the overlap interval is greater than thirty-five seconds.

13. The apparatus of claim 9, wherein the first and second encoding processes are responsive to the first and second control parameters, respectively, and the overlap interval is greater than 4,500 milliseconds.

14. The apparatus of claim 9, wherein the threshold amount is such that differences in audio signals decoded from encoded audio information for the third block according to the first and second control parameters are imperceptible.

15. The apparatus of claim 9, wherein the first and second control parameters represent values of a factor used in a decoding process that is complementary to the first and second encoding processes, and wherein the threshold amount represents a change in the factor equal to 1 dB.

16. The apparatus of claim 9, wherein the first and second control parameters are represented by values that are quantized according to a quantization step size and the threshold amount is an integer number of quantization step sizes greater than or equal to zero.

17. A medium conveying a program of instructions that is executable by a device to perform a method for encoding a stream of audio information comprising audio samples arranged in a sequence of blocks, each block having a respective start and end, wherein a first block precedes a second block, a third block follows the second block, a fourth block immediately follows the third block, and a fifth block follows the fourth block, and wherein the method comprises:

(a) identifying first and second segments of the stream of audio information that overlap one another by an overlap interval, wherein (1) the first segment comprises a plurality of blocks that starts with the first block and ends with the third block, (2) the second segment comprises a plurality of blocks that starts with the second block, includes the fourth block, and ends with the fifth block, and (3) the overlap interval extends from the start of the second block to the start of the fourth block;

(b) applying a first encoding process to the first segment of the stream of audio information to generate blocks of first encoded audio information and a first control parameter corresponding to blocks of audio samples up to and including the third block, wherein (1) the first encoded audio information in a block is generated in response to a corresponding block of audio samples in the first segment of the stream of audio information up to and including the third block;

(2) the first control parameter in the block is generated in response to the corresponding block of audio samples and preceding blocks of audio samples in the first segment of the stream of audio information from the first block up to and including the third block, and (c) applying a second encoding process to the second segment of the stream of audio information to generate blocks of second encoded audio information and a second control parameter corresponding to blocks of audio samples from the fourth block up to and including the fifth block, and to generate a second control parameter corresponding to audio samples in the third block, wherein (1) the second encoded audio information in a block is generated in response to a corresponding block of audio samples in the second segment of the stream of audio information from the fourth block up to and including the fifth block, (2) the second control parameter in the block is generated in response to the corresponding block of audio samples and preceding blocks of audio samples in the second segment of the stream of audio information from the second block up to and including the fifth block, and (3) the overlap interval is such that a difference between values of the first and second control parameters for the third block is less than a threshold amount; and (d) assembling the blocks of first and second encoded audio information into an output signal, wherein (1) the first and second control parameters are assembled into the output signal, or (2) the first encoding process generates the first encoded audio information in response to the first control parameter and the second encoding process generates the second encoded audio information in response to the second control parameter.

18. The medium according to claim 17, wherein the stream of audio information is arranged in frames, each frame having a plurality of blocks, the first, second and fourth blocks are beginning blocks in respective frames, and the third and fifth blocks are ending blocks in respective frames.

19. The medium according to claim 17, wherein the first and second encoding processes generate encoded audio information by applying filterbanks to the blocks of audio samples that cause time-domain aliasing artifacts to be generated by complementary decoding processes applied to the encoded audio information, and the blocks of audio samples in the sequence of blocks overlap one another by an amount that allows the complementary decoding processes to mitigate effects of the time-domain aliasing artifacts.

20. The medium of claim 17, wherein the first and second control parameters are assembled into the output signal and the overlap interval is greater than thirty-five seconds.

21. The medium of claim 17, wherein the first and second encoding processes are responsive to the first and second control parameters, respectively, and the overlap interval is greater than 4,500 milliseconds.

22. The medium of claim 17, wherein the threshold amount is such that differences in audio signals decoded from encoded audio information for the third block according to the first and second control parameters are imperceptible.

23. The medium of claim 17, wherein the first and second control parameters represent values of a factor used in a decoding process that is complementary to the first and second encoding processes, and wherein the threshold amount represents a change in the factor equal to 1 dB.

24. The medium of claim 17, wherein the first and second control parameters are represented by values that are quantized according to a quantization step size and the threshold amount is an integer number of quantization step sizes greater than or equal to zero.

* * * * *